US007701404B2

(12) United States Patent
McKivergan

(10) Patent No.: US 7,701,404 B2
(45) Date of Patent: Apr. 20, 2010

(54) METHOD AND APPARATUS FOR LIMITING VSWR SPIKES IN A COMPACT BROADBAND MEANDER LINE LOADED ANTENNA ASSEMBLY

(75) Inventor: Patrick D. McKivergan, Londonderry, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 681 days.

(21) Appl. No.: 10/557,027

(22) PCT Filed: Dec. 19, 2003

(86) PCT No.: PCT/US03/40487

§ 371 (c)(1),
(2), (4) Date: Nov. 14, 2005

(87) PCT Pub. No.: WO2005/006494

PCT Pub. Date: Jan. 20, 2005

(65) Prior Publication Data

US 2006/0256029 A1 Nov. 16, 2006

(51) Int. Cl.
*H01Q 11/12* (2006.01)

(52) U.S. Cl. ..... 343/742; 343/700 MS; 343/895

(58) Field of Classification Search ..... 343/700 MS, 343/702, 742, 744, 749, 895
See application file for complete search history.

(56) References Cited

U.S. PATENT DOCUMENTS

| | | | | |
|---|---|---|---|---|
| 5,790,080 | A * | 8/1998 | Apostolos | 343/744 |
| 5,880,697 | A * | 3/1999 | McCarrick et al. | 343/742 |
| 6,339,402 | B1 * | 1/2002 | McKivergan | 343/702 |
| 6,429,818 | B1 * | 8/2002 | Johnson et al. | 343/702 |
| 6,686,884 | B2 * | 2/2004 | Back et al. | 343/700 MS |
| 6,734,825 | B1 * | 5/2004 | Guo et al. | 343/700 MS |
| 6,903,692 | B2 * | 6/2005 | Kivekas et al. | 343/702 |
| 6,956,530 | B2 * | 10/2005 | Kadambi et al. | 343/702 |
| 6,995,710 | B2 * | 2/2006 | Sugimoto et al. | 343/700 MS |
| 7,183,976 | B2 * | 2/2007 | Wu et al. | 343/700 MS |
| 2005/0248499 | A1 * | 11/2005 | Park et al. | 343/895 |
| 2007/0115199 | A1 * | 5/2007 | Apostolos | 343/795 |

* cited by examiner

*Primary Examiner*—Tan Ho
(74) *Attorney, Agent, or Firm*—Robert K. Tendler; Daniel J. Long

(57) ABSTRACT

A method of operating a higher conductivity broadband loaded meander line antenna (10) is provided wherein the meander line is positioned on a sheet of a lower conductivity material (22) having a conductivity of from about 0.01 siemens/m to about 0.10 siemens/m; and allowing a first electrical current to flow in a first current path in the meander line. An electrical field is formed in the vicinity of the lower conductivity material and a second current flows in a second current path in the lower conductivity material, whereby anti-resonance in the meander line loaded antenna is diminished so that a broadband response can be achieved over bandwidths of 5:1 or more. An assembly for carrying out this method is also disclosed.

17 Claims, 4 Drawing Sheets

METHOD AND APPARATUS FOR LIMITING VSWR SPIKES IN A COMPACT BROADBAND MEANDER LINE LOADED ANTENNA ASSEMBLY

STATEMENT OF GOVERNMENT INTEREST

The invention described herein was made under Contract No. MDA 972-00-9-0009 with the Government of the United States of America and may be manufactured and used by and for the Government of the United States of America for Governmental purposes without the payment of any royalties thereon or therefor.

FIELD OF THE INVENTION

The present invention relates to antennas and more particularly to broadband meander line antennas.

BACKGROUND OF THE INVENTION

Modern military communication systems require antennas that are small, broadband and have good gain. It is difficult to make electrically small antennas (i.e. less than ¼-wavelength in maximum linear dimension) broadband without seriously impacting gain performance.

One widely used method of making an electrically small antenna broadband is to add a resistive taper along the length of the antenna. This taper is usually determined empirically. More recently, people have applied genetic algorithms (GA) to arrive at an optimal taper.

A major disadvantage of the resistive taper is the amount of resistance that needs to be added to an electrically small antenna in order to achieve a good VSWR (i.e. <3:1) which severely reduces the gain of the antenna due to ohmic losses. Additionally, the taper affects gain at all frequencies since it is in series with the element.

The problem with all broadband antennas is to make sure the VSWR is uniformly low, less than 3:1, over the entire band. What often occurs is that there are large VSWR spikes which can exceed 10:1. Since the VSWR spikes induce mismatch loss, this significantly diminishes the ability to pump in energy to the antenna at various points in the broad frequency band that the antenna is to operate over.

What is desired is to have a broadband antenna which does not have VSWR spikes so that it has a uniform operation across the band.

Broadband meander line loaded antennas are described in U.S. Pat. Nos. 5,790,090; 6,313,716; 6,323,814; 6,373,440; 6,373,446; 6,480,158; 6,492,953; and 6,404,391, incorporated herein by reference and assigned to the assignee hereof. U.S. Pat. No. 6,590,543 describes a double monopole meander line loaded antenna used for instance in airborne applications in a dome-like configuration.

In each of the above meander line loaded antennas or antenna couplers the meander lines are insulated from a plate or sheet by a dielectric layer. The designs of such antennas or couplers can be maximized for bandwidth by a number of techniques described in the above patents.

Oftentimes, however, VSWR spikes across the broad bandwidth provide the antenna designer with problems when seeking to provide a uniform smooth low VSWR across the entire broadband.

A need, therefore, exists for a broadband meander line antenna assembly which may be small and is broadband with good gain characteristics and yet have a uniform low VSWR across the band.

SUMMARY OF THE INVENTION

In the subject invention a meander line of one or more segments is spaced from the associated conductive plate by a lossy dielectric material. This permits inserting a distributed resistance under low impedance sections of the meander line so as to provide the entire meander line structure with the distributed resistance to reduce VSWR spikes without affecting bandwidth. The insertion of this lossy material in essence smoothes out the VSWR by minimizing mismatches.

A meander line loaded antenna is a tuned circuit realized in many forms, one of which is a folded transmissionline meander line structure of alternating high and low impedances. Past implementations of such a structure utilize a dielectric material to insulate the meander line from a conductive plate normally used. Such an antenna structure exhibits an anti-resonant point or frequency between the natural resonant frequency fo and 0.5 fo which is very difficult to match. At the anti-resonant point, it has been found that very little current flows in the meander line but very high electric fields exist. By mounting the meander line structures on a sheet of a poor conductor material having, for instance, conductivities on the order of from about 0.01 siemens/m to about 0.1 siemens/m instead of using dielectrics, the anti-resonance is significantly diminished due to conduction current flowing in the material as a result of the high electric fields. Thus two distinct current paths are provided in the structure which are: (1) current through the meander line element and (2) current through a lossy sheet on which the meander line is mounted. By properly choosing the meander line geometry and lossy sheet properties, broadband response can be achieved over bandwidths of 5:1 or more.

It has been found in the past that lowering the natural resonant frequency of an antenna structure is possible by utilizing meander line elements. However, all resulting antennas exhibit a strong anti-resonance between the tuned frequency and the natural resonant frequency of the structure. This anti-resonance is difficult to match and results in large VSWR spikes. It has been discovered, however, that at the anti-resonant point, very little current flows in the meander line element and that very large electric-fields exist in the vicinity of the meander line element. By mounting the meander line on a poor conductor, conduction current is caused to flow at the anti-resonant frequency resulting in suppression of VSWR spikes. This in turn results in broadband behavior that has a uniform or smooth low VSWR over the entire broadband operating frequency band.

In summary, a method of operating a higher conductivity broadband loaded meander line antenna is provided wherein the meander line is positioned on a sheet of a lower conductivity material having a conductivity of from about 0.01 siemens/m to about 0.10 siemens/m; and allowing a first electrical current to flow in a first current path in the meander line. An electrical field is formed in the vicinity of the lower conductivity material and a second current flows in a second current path in the lower conductivity material, whereby anti-resonance in the meander line loaded antenna is diminished so that a broadband response can be achieved over bandwidths of 5:1 or more. An assembly for carrying out this method is also disclosed.

BRIEF DESCRIPTION OF THE DRAWINGS

These and other features of the subject invention will be better understood in connection with a detailed description in conjunction with the drawings, of which.

DETAILED DESCRIPTION

Figure 1:
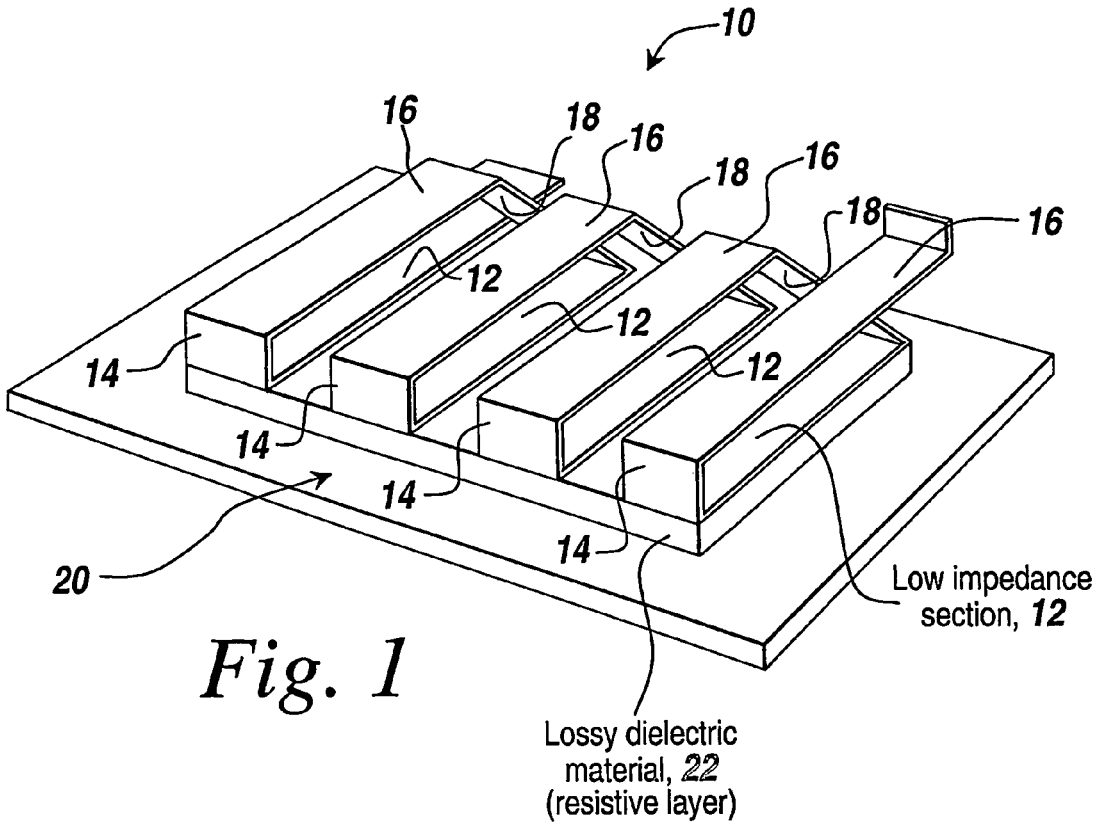
FIG. 1 is a diagrammatic illustration of a meander line located above a conductive plate and spaced therefrom with a lossy dielectric material, thus to minimize VSWR spikes.

Referring to FIG. 1, a meander line 10 includes a number of low impedance sections 12 coupled to high impedance sections 14, which are in turn coupled to upper sections 16, with each corresponding to a meander line segment. Note that the segments are serially connected, as can be seen by conductors 18.

As is typical, the meander line structure is spaced from a conductive plate 20 and in this case by a lossy dielectric material 22, which lies between low impedance sections 12 and plate 20. This lossy dielectric material is in essence a resistive layer and in one embodiment is available from Eccosorb as model VF-30.

Figure 2:
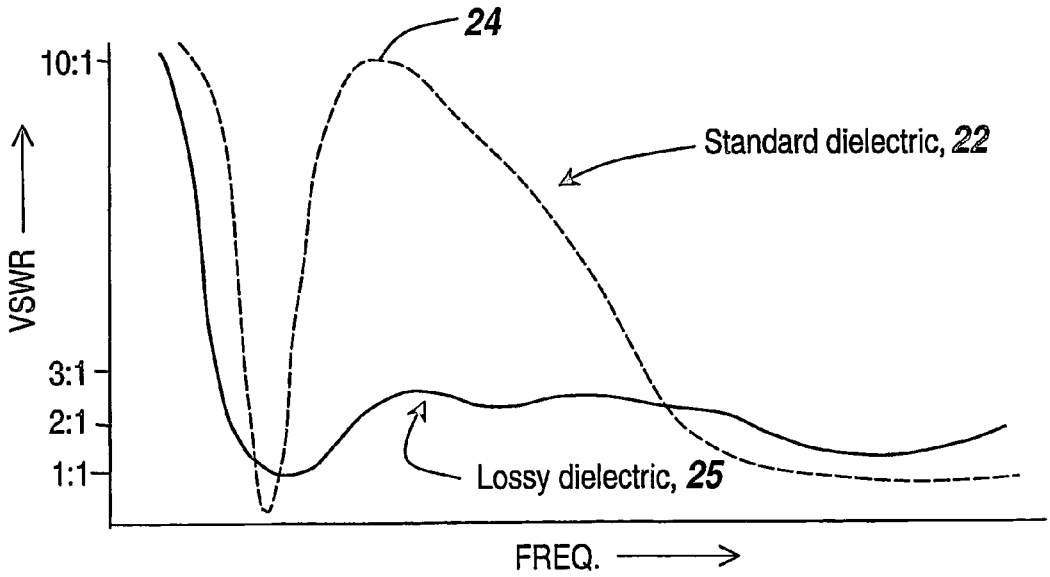
FIG. 2 is a graph of VSWR versus frequency for a meander line loaded antenna, showing spikes associated with the standard dielectric versus a smoothing effect associated with the utilization of the subject lossy dielectric material.

Referring to FIG. 2, one such meander line is formed as part of a meander line loaded antenna. If a standard dielectric is utilized as the layer between the meander line and the conductive plate, then the VSWR curve 22 is occasioned by high VSWR peaks 24 at various frequencies. The result is that at these frequencies there is a substantial impedance mismatch which results in the difficulty of transferring energy to the meander line loaded antenna or meander line loaded coupler.

Figure 3:
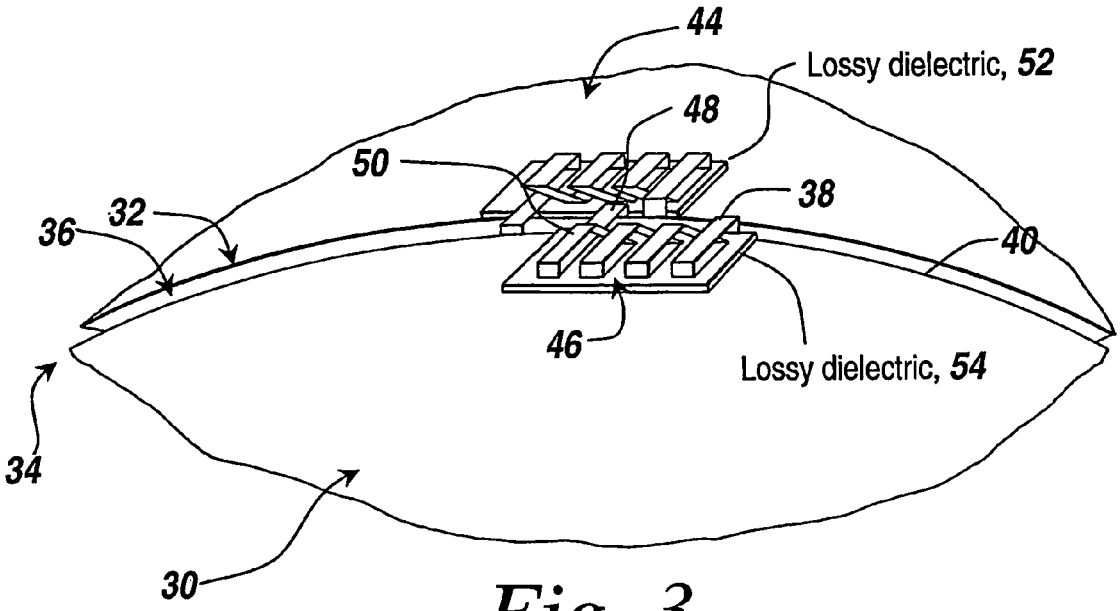
FIG. 3 is diagrammatic illustration of the utilization of a pair of meander lines utilized on a hemispherical double monopole meander line loaded antenna, illustrating the utilization of the lossy dielectric material to produce VSWR spikes.

While the utilization of a lossy dielectric material is available for use in any of the aforementioned meander line loaded antenna or coupler applications, by way of illustration, a bifurcated hemispherical double monopole antenna is illustrated in FIG. 3 to include semi-hemispherical halves 30 and 32, separated by a slot 34. Interposed in this slot is a vertical plate 36 which has a fan-shaped configuration. A point 38 on the top edge 40 of the fan-shaped vertical plate is coupled to respective meander lines 44 and 46 at respective points 48 and 50. Each of the meander lines 44 and 46 is mounted to the top surface of respective semi-hemispherical conductors by lossy dielectric layers 52 and 54 as illustrated.

Figure 4:
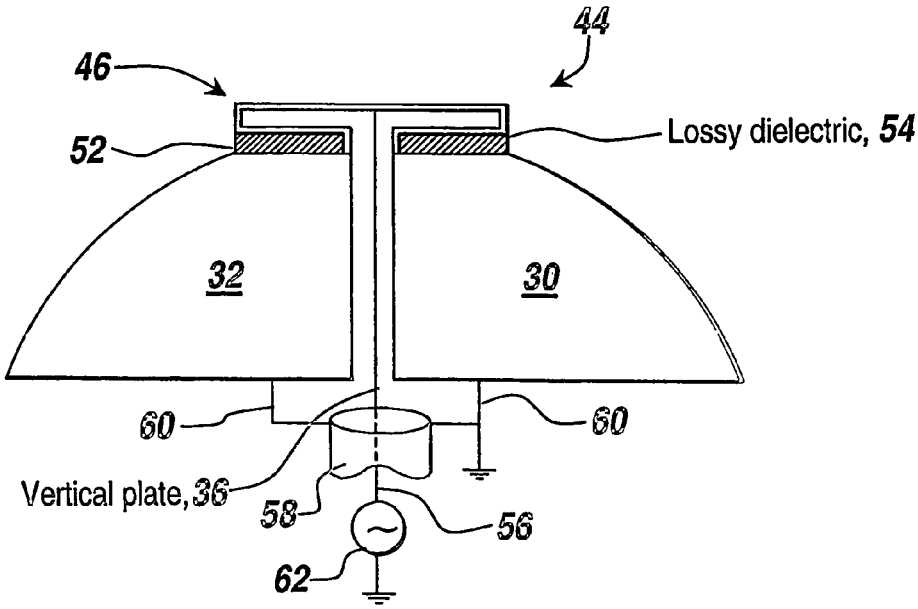
FIG. 4 is a diagrammatic illustration of a side view of the double monopole hemispherical antenna of FIG. 3, illustrating the placement of the lossy dielectric material and the central feed for the antenna, which includes a vertical plate between the two hemispherical elements.

From a side view and referring to FIG. 4, the bifurcated hemispherical antenna can be seen as including semi-hemispherical elements 30 and 32 carrying meander lines 44 and 46. The antenna is fed by vertical plate 36, in turn coupled to the central conductor 56 of a coaxial cable feed 58, which has its outer braid grounded to the semi-hemispherical sections as illustrated at 60. A signal source 62 drives center conductor 56 between conductor 56 and ground.

In one embodiment, the meander line loaded antenna of FIG. 3 employs meander lines for tuning the antenna lower than its natural resonant frequency. The natural resonant frequency of the illustrated antenna is about 60 MHz. The meander lines are insulated from the semi-hemispherical pates by the aforementioned lossy dielectric sheets.

In this embodiment, two meander lines are used that are tuned to slightly different frequencies in order to provide a double resonance, one at 32.1 MHz and one at 35.5 MHz in an attempt to enhance bandwidth. Alternatively, other bandwidth enhancing techniques noted above may be utilized.

Figure 5:
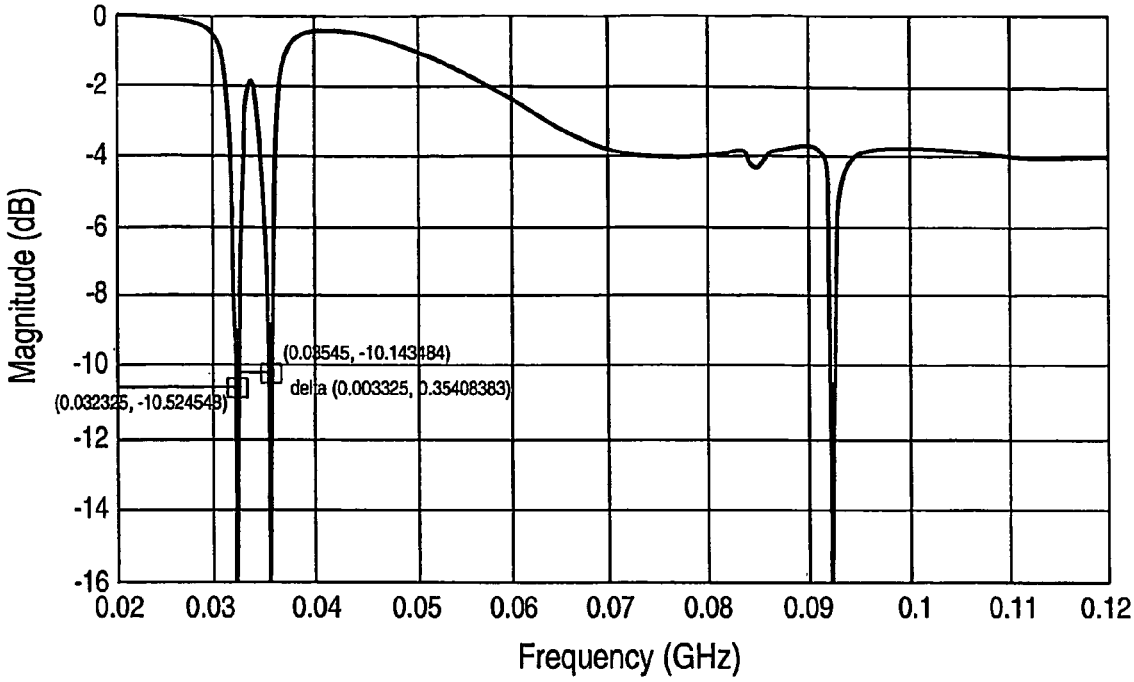
FIG. 5 is a graph of attenuation versus frequency for the antenna of FIG. 3 to show the anti-resonance at 33.5 MHz.
Figure 6:
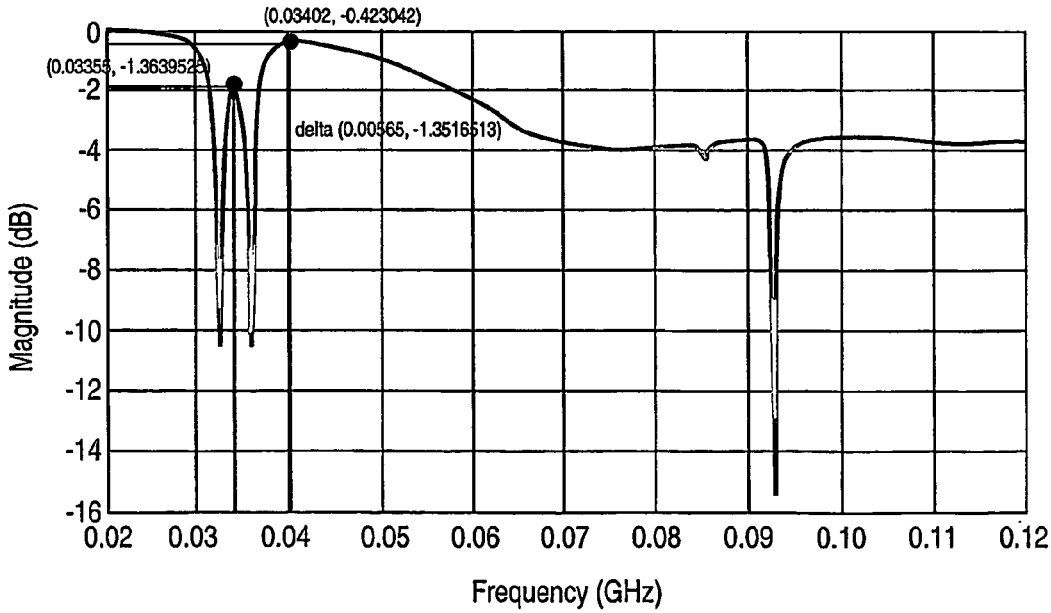
FIG. 6 is a graph of attenuation versus frequency for the antenna of FIG. 3 to show the anti-resonance at 40 MHz; and, FIG. 7 is a graph of VSWR versus frequency for various configurations of the antenna of FIG. 3 where no tuning stub is used where a resistive loaded turning stub is used and where a dielectric loaded turning stub is used.

In the illustrated embodiment, there are correspondingly two anti-resonances at 33.5 MHz and 40 MHz where the return loss is very poor. This behavior is shown in FIGS. 5 and 6. It has been found that the surface currents in the antenna at the resonant and anti-resonant frequencies have magnitudes that are significantly larger at the resonant frequencies than at the anti-resonant frequencies. The inability for current to flow at the anti-resonant frequencies causes the impedance to be very high and thus difficult to match. Since there is no current flowing at anti-resonance, very high electric fields exist in the vicinity of the meander line element.

When the meander line substrate is a good dielectric with a low loss-tangent, the applied electric field does not cause current to flow from the meander line element directly to the associated plate. By replacing the dielectric between the meander line and the plate with a poor conductor having conductivities on the order of 0.2 to 0.01 siemens/meter, an alternate RF current path is provided which diminishes VSWR spikes and yields a broadband response.

Figure 7:
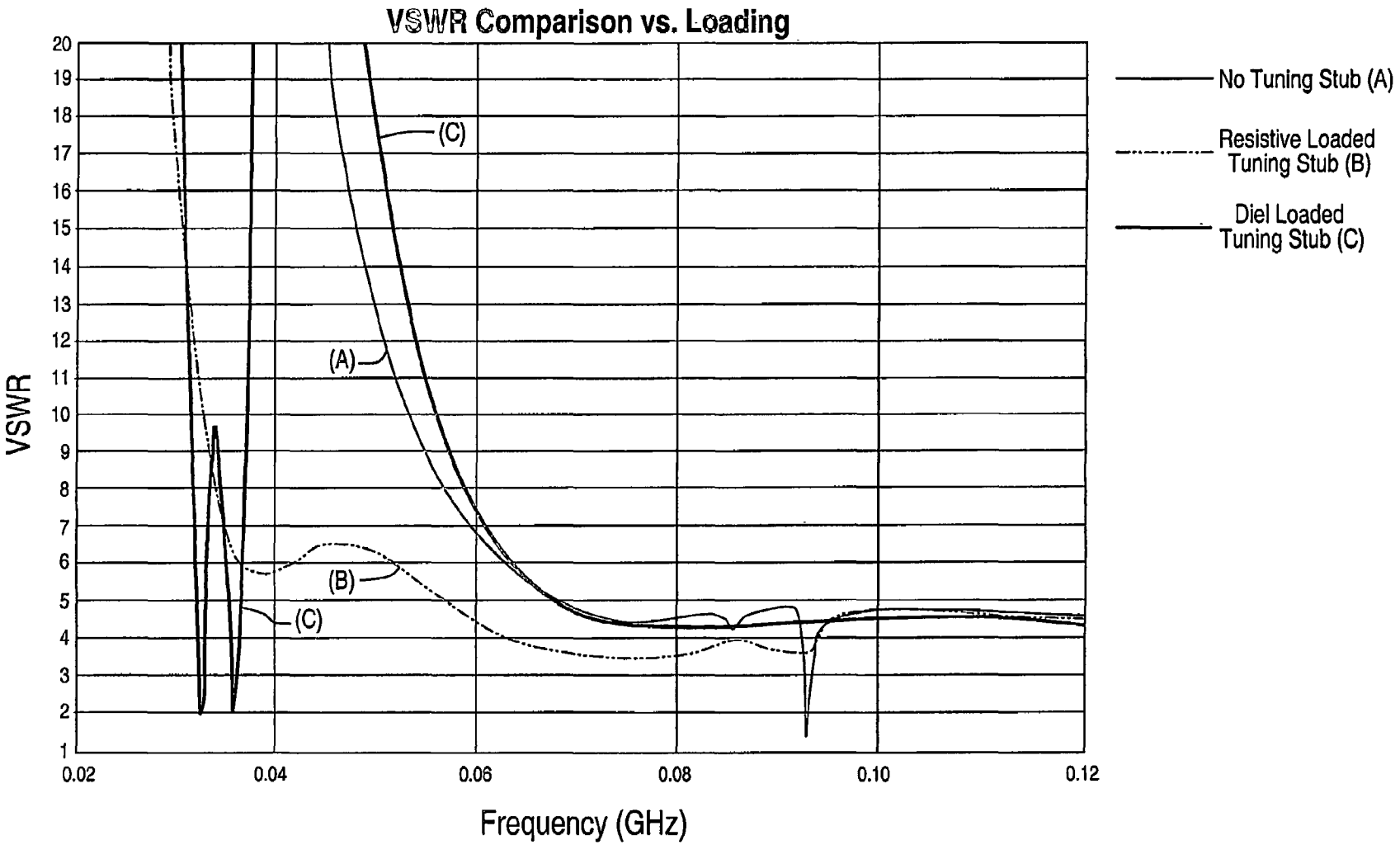

FIG. 7 shows the VSWR of the antenna assembly for three cases: (1) no meander line loading, which shows the natural resonant frequency of the structure, (2) meander line loading on a dielectric substrate which shows two narrow-band resonances and corresponding anti-resonances, and, (3) meander line loading on a resistive substrate whose conductivity is 0.14 siemens/meter, which limits spiking, smoothes the VSWR and provides the broadband response.

Note that the gain of the antenna of FIG. 3 is 12 dB higher than a 24-inch resistive blade which has 50% more vertical dimension, clearly indicating the gain advantage of the subject resistively-loaded meander line approach.

While the present invention has been described in connection with the preferred embodiments of the various figures, it is to be understood that other similar embodiments may be used or modifications or additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A method for minimizing VSWR spikes in a meander line loaded antenna having a number of electrically interconnected meander line conductive sections including at least one low impedance meander line section located above a conductive plate comprising interposing a poor conductor between the low impedance section and the conductive plate.

2. The method of claim 1, wherein the resistivity of the poor conductor is 0.01 siemens/meter to 0.2 siemens/meter.

3. The method of claim 1, wherein the meander line has a number of segments, each segment having a low impedance section, the poor conductor extending between the conductive plate and the low impedance sections of the segment.

4. The method of claim 1, wherein the antenna is a double monopole meander line loaded antenna.

5. The method of claim 4, wherein the double monopole meander line loaded antenna includes a bifurcated hemispherical surface, each comprised of semi-hemispherical surfaces.

6. A method of minimizing VSWR spikes in a meander line antenna coupler having at least one low impedance meander line section located above a conductive plate, comprising interposing a poor conductor between the low impedance section and the conductive plate.

7. The method of claim 6, wherein the resistivity of the poor conductor is 0.01 siemens/meter to 0.2 siemens/meter.

8. A meander line loaded antenna comprising:

a meander line having at least one low impedance section;

a conductive plate; and, a layer of a poor conductor interposed between said low impedance section and said plate, whereby a distributed resistance is positioned at said meander line to limit VSWR spikes without affecting the bandwidth of said antenna.

9. The antenna of claim 8, wherein said poor conductor has a resistivity of 0.01 siemens/meter to 0.2 siemens/meter.

10. The antenna of claim 8, wherein said poor conductor is in the form of a layer.

11. The antenna of claim 8. wherein said layer is a sheet.

12. The antenna of claim 8, wherein one end of said meander line is electrically connected to said conductive plate and wherein the other end of said meander line is the feed point for said antenna.

13. The antenna of claim 8, wherein said poor conductor includes a vinyl resistive plastic film.

14. A method for minimizing VSWR spikes in a meander line loaded antenna having at least one low impedance meander line section located above a conductive plate comprising interposing a lossy dielectric material between the low impedance section and the conductive plate, the meander line having a number of segments, each segment having a low impedance section, the lossy dielectric material extending between the conductive plate and the low impedance sections of the segment.

15. The method of claim 14, wherein the antenna is a double monopole meander line loaded antenna.

16. The method of claim 15, wherein the double monopole meander line loaded antenna includes a bifurcated hemispherical surface, each comprised of semi-hemispherical surfaces.

17. A meander line loaded antenna comprising:

a meander line having at least one low impedance section;

a conductive plate; and, a layer of lossy dielectric material interposed between said low impedance section and said plate, whereby a distributed resistance is positioned at said meander line to limit VSWR spikes without affecting the bandwidth of said antenna, one end of said meander line being electrically connected to said conductive plate and the other end of said meander line being the feed point for said antenna.

* * * * *